US006213874B1

(12) United States Patent
Heflin

(10) Patent No.: US 6,213,874 B1
(45) Date of Patent: Apr. 10, 2001

(54) COLLECTOR CARD/PHONE CARD DISPENSING SYSTEM WITH PROMOTIONAL FREE SPIN/FREE DRAW GAME FEATURE

(76) Inventor: Keith Heflin, 439 Naron Dr., Shelbyville, TN (US) 37160

( * ) Notice: Subject to any disclaimer, the term of this patent is extended or adjusted under 35 U.S.C. 154(b) by 0 days.

(21) Appl. No.: 08/925,860

(22) Filed: Sep. 9, 1997

(51) Int. Cl.[7] ..... A63F 9/22

(52) U.S. Cl. ..... 463/17; 463/36; 463/4; 273/118

(58) Field of Search ..... 463/16, 17–19; 273/118 A; 194/215, 217; 235/1 B, 1 R

(56) References Cited

U.S. PATENT DOCUMENTS 3,807,541 * 4/1974 Kortenhaus ..... 194/1
4,359,631 * 11/1982 Lockwood et al. ..... 235/381
4,669,730 * 6/1987 Small ..... 463/17
4,815,741 * 3/1989 Small ..... 273/138 A
4,882,473 * 11/1989 Bergeron et al. ..... 463/17
4,982,346 * 1/1991 Girouard et al. ..... 463/16
5,007,641 * 4/1991 Seidman ..... 463/17
5,137,278 * 8/1992 Schilling et al. ..... 273/118 A
5,179,517 * 1/1993 Sarbin et al. ..... 463/16
5,266,784 * 11/1993 Trotta et al. ..... 235/375
5,362,051 * 11/1994 Swafford, Jr. et al. ..... 463/16
5,411,259 * 5/1995 Pearson et al. ..... 463/17
5,551,692 * 9/1996 Pettit et al. ..... 463/16
5,620,079 * 4/1997 Molbak ..... 194/217
5,674,128 * 10/1997 Holch et al. ..... 463/42
5,743,801 * 4/1998 Welander ..... 463/44
5,791,991 * 8/1998 Small ..... 463/41
5,868,236 * 2/1999 Rademacher ..... 194/217

* cited by examiner

*Primary Examiner*—Valencia Martin-Wallace
*Assistant Examiner*—John M Hotaling, II
(74) *Attorney, Agent, or Firm*—Waddey & Patterson; Mark J. Patterson

(57) ABSTRACT

A system for dispensing collector's series cards to a collector includes a currency acceptor and card dispenser controlled by a computer. As a promotion to encourage the sale of the collector's cards, the system includes a game subsystem that provides the purchaser with an opportunity to play a game of chance with the credits that the person receives with each collector's series card purchased. The purchaser may then save such credits or play them, and to the extent that a person wins, a promotional prize will be awarded.

9 Claims, 4 Drawing Sheets

COLLECTORS CARD DISPENSER AND PROMOTIONAL GAME FLOW CHART

COLLECTOR CARD/PHONE CARD DISPENSING SYSTEM WITH PROMOTIONAL FREE SPIN/FREE DRAW GAME FEATURE

APPLICATION FOR UNITED STATES LETTERS PATENT

Be it known that I, Keith Heflin, a citizen of United States, residing at 439 Naron Drive, Shelbyville, Tenn. 37160; have invented a new and useful "Collector Card/Phone Card Dispensing System with Promotional Free Spin/Free Draw Game Feature."

BACKGROUND OF THE INVENTION

This invention relates generally to collector's series card distribution, and, in particular, to a card dispensing machine and system that includes a promotional Free Spin/Free Draw game feature used to increase interest in purchasing such cards. A distinctive feature of this system is the unique manner in which the cards are dispensed in conjunction with an opportunity to play credits obtained with the purchase of a card on an instant win game.

Collecting special collector's series cards has become increasingly popular with the general public. Such cards are used for entertainment purposes in various ways, such as exchanging them with other collectors or saving them as a memento containing special significance to the collector. Collecting these cards has grown to such a great extent that it is reported that certain distributors of collector's series cards disburse over one billion cards each year. Therefore, distributors are continuously looking for new and unusual ways to distribute the cards and to increase interest in their particular brand of cards.

Most new collector's cards are purchased at retail stores and specialty shops from counter stock or display stock. The customer selects the card or card package and then pays a clerk or cashier. Promotions are often tied into the sale, such as bubble gum, three-dimensional cards, and stickers, to increase distribution. Therefore, it is advantageous to a distributor to provide a distinguishing promotion in order to encourage adults to purchase their collector's series cards. What is needed, however, is a method of distributing collector's cards to customers that is efficient and low cost and that adds promotional value to the transaction.

SUMMARY OF THE INVENTION

The present invention provides an automated dispenser system and method for distributing collector's series cards that includes a promotional device that offers an opportunity to play an instant win game. In accordance with one object of the invention, a dollar bill valuator accepts a bill from a collector and then a computerized card dispenser delivers a collector card to the collector in response thereto. To increase the value to the collector, the card dispensing device includes a promotional feature which confers a credit to play, for amusement, a video game simultaneously with the purchase of a collector's card. The holder of the credit can then play an instant win game in order to try to win more credits. After playing the game, the holder then has the option to save any won credits for future use in an attempt accumulate more credits, which could eventually lead to a promotional prize. At any point during the game, after the holder accumulates more points than he received for promotional play, the holder has the option to obtain a prize in exchange for the credits.

The operation of the system is overseen by a licensee who is able to assist in the distribution of games. The licensee is needed to enter credits into the video game system for persons with vouchers for free games, and the licensee further provides for later continuance of the game by withdrawing credits and resetting the number of credits on the machine.

A preferred embodiment of the system combines a conventional microprocessor or computer and video display monitor, operatively connected to a promotional game subsystem that provides the method for operation of the game, and an interface card which allows the card dispenser to work in conjunction with the distribution of the collectible cards and credits after the insertion of the required amount of money.

When the card dispenser is depleted of cards, two things occur. An interrupt switch is activated by the interface card to disable the system from playing until the licensee of the system places more cards in the dispenser. Concurrently, an "Out of Service" light on the cabinet is illuminated and the licensee of the system is thereby notified to replenish the system with cards.

The game is played by programming the computer with a simple game algorithm of the licensor's choice. In one embodiment of the system, first, either money is inserted and a collector's card is distributed, or a licensee provides a free credit through the promotional play switch. The user then has the option of playing the game. If the user chooses not to play, then the free games are removed and the machine is reset through a credit removal switch. If the user chooses to play, a simple algorithm for the game allows the user to play his credits.

If the user loses, the game automatically removes his played credits and asks if he wishes to play again through the purchase of another collector's series card. If the user wins, he has the option to either take or double-up. If he takes, then he has the option to either play and go through the process again, or he can choose to receive the promotional prize awarded for the amount of credits that he has accumulated. If he doubles-up, the game is played and if he wins then he has the opportunity to take the winnings or play again. If he loses, then he returns to play the remainder of his credits.

DESCRIPTION OF THE PREFERRED EMBODIMENTS

Figure 1:
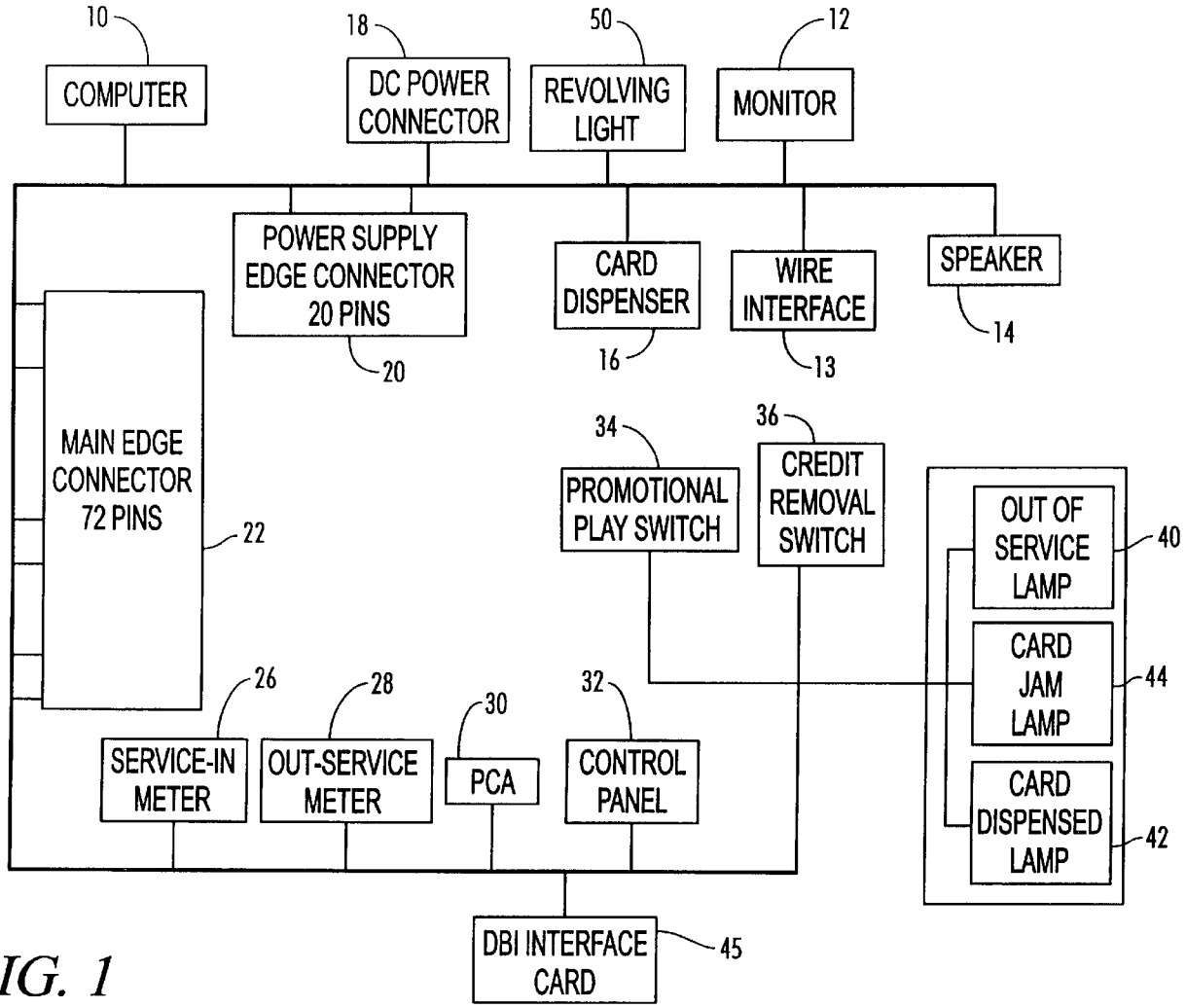
FIG. 1 is a block diagram of the card dispenser and promotional game system of the present invention.

Referring now to the drawings, FIG. 1 shows the connection of the main components of the collector's card dispensing system of the present invention: a computer 10, a card dispenser apparatus 16, and a user interface/control panel 32. These components are integrated together via a wired interface 13 through a 72-pin main edge connector 22. The interface will incorporate a power supply bus and a data bus to provide for communication of electrical signals and commands to the various electronic and electromechanical devices shown on FIG. 1.

The card dispenser 16 is a conventional electromechanical machine used to distribute the collector's series cards upon insertion of money into the paper currency acceptor ("PCA") 30. The PCA 30 is conventionally used in food vending machines, and sends an electrical signal to the computer 10 to register the correct amount of currency received credits in relation to the value of the bill inserted. The computer 10 through the use of an interface card 45 then directs the card dispenser 16 to issue the cards and provides the user the opportunity to play a promotional game.

Figure 3:
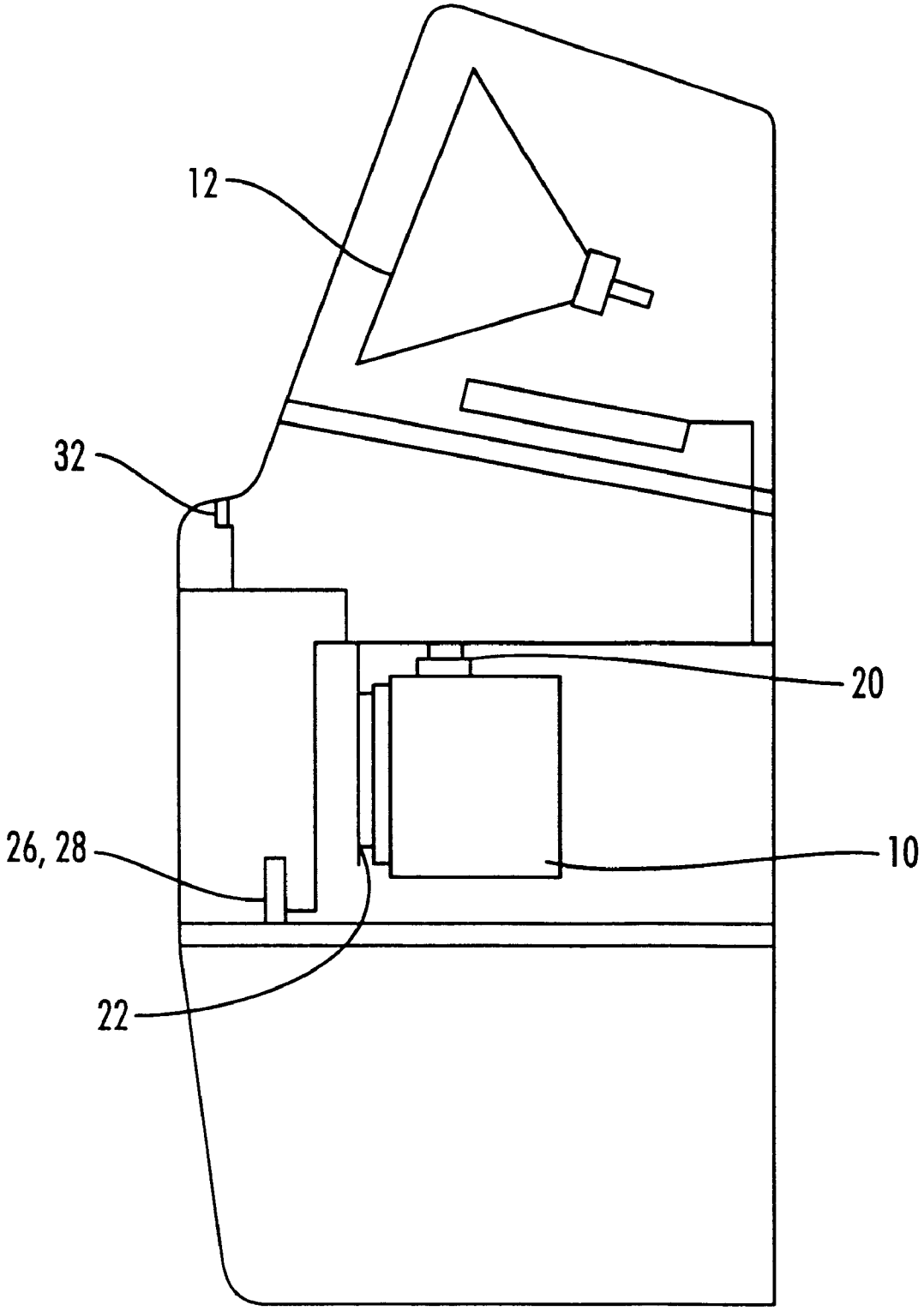
FIG. 3 is a side view of the system in the cabinet.

The user communicates all actions of the game through the user interface provided by the control panel 32, as shown in FIG. 3. The control panel 32 is a conventional interface between the user and the computer program that allows the user to play the game. The control panel 32 includes buttons to register the user's plays, and to allow the user to double-up or withdraw from the game.

In the operation of the card dispensing system 16, the user first enters paper currency into the PCA 30 and the promotional play switch 34 is set to position "A". The PCA 30 then sends a signal to the computer 10 in relation to the value of the bill entered and registers the play credits on the service-in meter 26.

Figure 2:
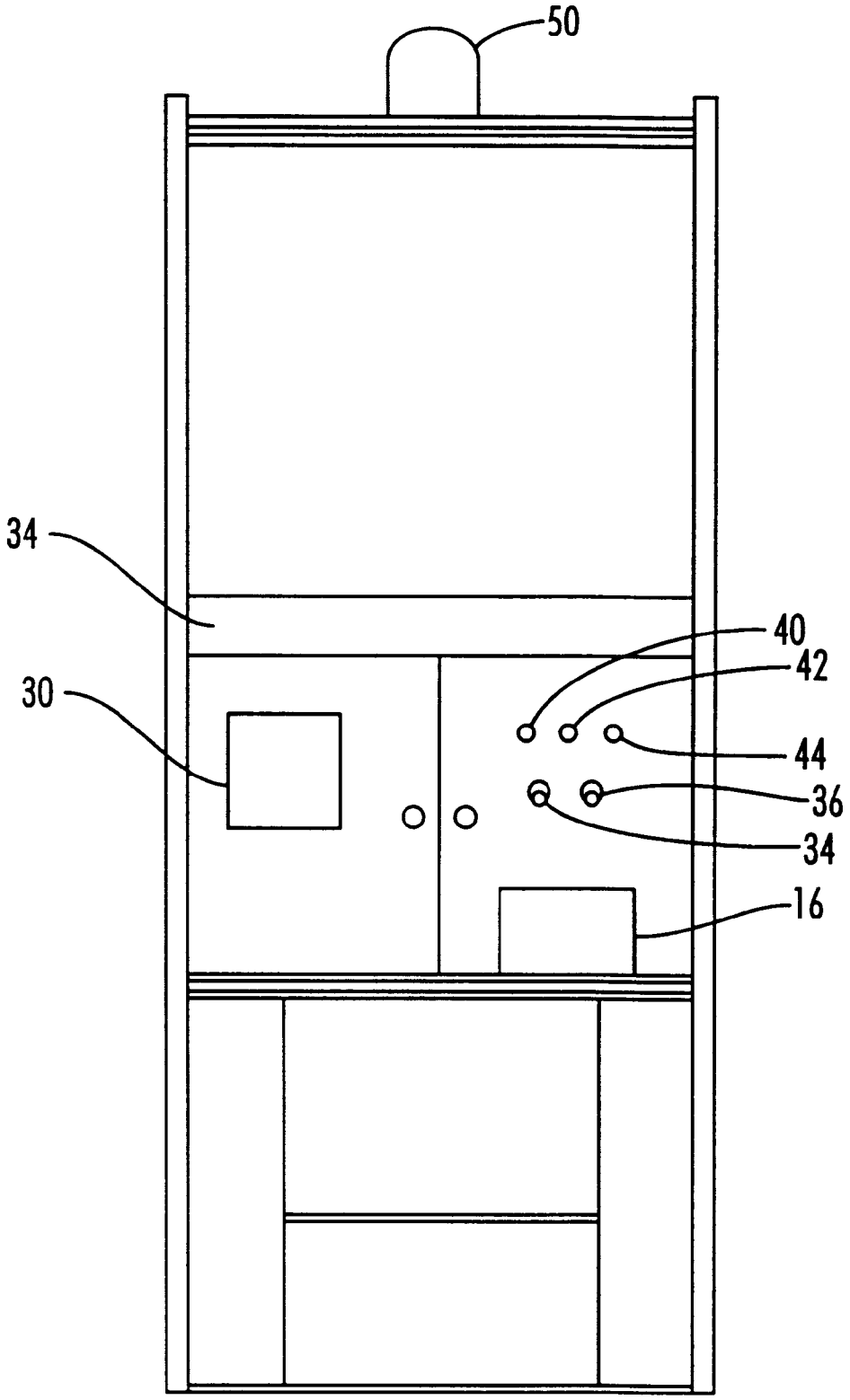
FIG. 2 is a front side view of the system cabinet showing the control panel and display.

During operation of the game, the computer 10 can generate effects to make the game more exciting. A speaker system 14 may be connected to the computer 10 to allow for sound effects or any other type of beneficial sound. Further, a revolving light 50 may be placed on top of the cabinet containing the system to be activated when a user wins, as shown in FIG. 2.

When the user is finished, the licensee removes the credits by activating the credit removal switch 36 and the credits are removed from system memory. The system memory (not shown) is conventional RAM compatible with the computer 10. The remaining credits would then accumulate in the out-service meter 28. The out-service meter 28 would then provide the licensee a physical record, stating the number of credits won or unused by the user.

If the card dispenser 16 should become empty, an interrupt switch located inside the card dispenser 16 would prevent operation of the system until the card dispenser 16 is refilled. Simultaneously, an "Out of Service" lamp 40 would be illuminated, thereby notifying the licensee to replenish the card supply.

Further, the system provides for two other indicator lamps. A "Card Jam" lamp 44 notifies licensee if the dispenser becomes jammed. A "Card Dispensed" lamp 42 notifies the user that the collector's series card has been delivered into the retaining area of the cabinet 42.

Figure 4:
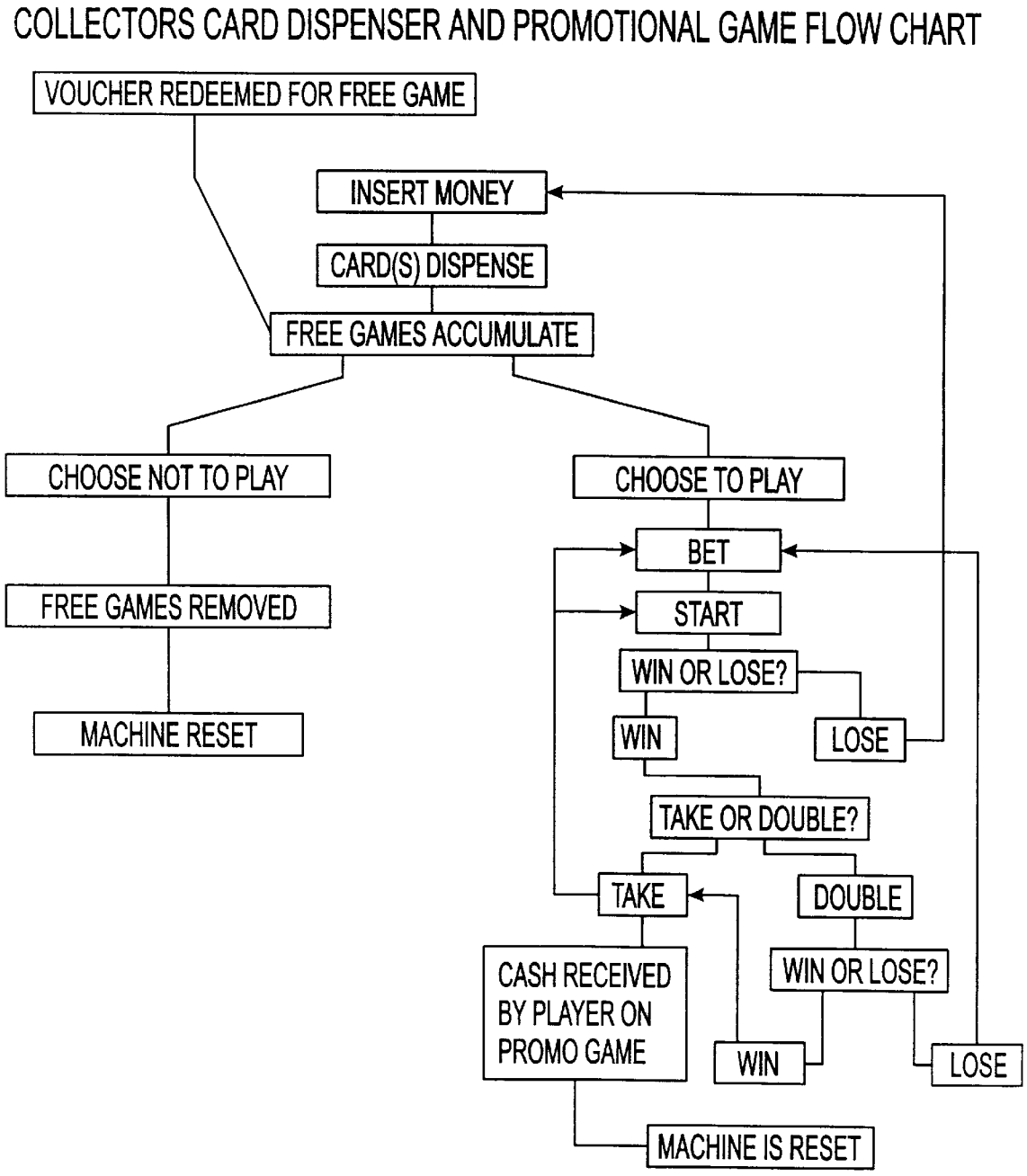
FIG. 4 is a flow chart showing the basic sequence of playing the promotional game.

The computer 10 generates the game using a simple algorithm as part of a promotional game sub-system incorporated into the system software. The basic sequence of logical operations implemented by the software, including the promotional game subsystem, is shown on the flow chart of FIG. 4. A person skilled in the art of computer programming could easily implement these steps in software compatible with the particular processor selected for use with the computer 10. After the user inserts money into the PCA 30, a corresponding currency received credit signal is sent to the computer 10 and to the interface board 45. The interface board 45 signals the card dispenser 16 to deliver the collector cards to the user. The computer 10 then determines the available credits from either the insertion of money in the PCA 30, at which time the promotional play switch 34 is set to position "A", or through the licensee entering credits via the promotional play switch 34 being set to position "B". The credits accumulate at that point and the user has the option of playing the promotional game.

The information needed to advise the user of his game playing options before and during game play is generated by the computer 10 and is displayed to the user via the monitor 12. The user then communicates with the promotional game, the system is reset via the credit removal switch 36, and the credits are registered in the out-service meter 28.

If the user chooses to play the promotional game, then the computer 10 allows the user to play his credits. If the user loses, then the system is reset by the computer 10 and the system resets to offer a new card and game to the same or different user for a specified amount of money.

If the user wins, then he has the option to either quit the game or to double-up. If the user chooses not to play, then he can receive the accumulated credits and a promotional prize, or he can play again. If the user chooses to double-up, then he plays again. If he loses, the game automatically requests another amount to play. If he wins, he has the option to either take the credits or play again. If he takes the creditts, then he receives the accumulated credits that can be used to get a promotional prize awarded for the amount of credits that he has accumulated.

When the user does decide to withdraw from the game, the licensee would then activate the credit removal switch 36, which would then signal the computer 10 to send the accumulated points into the out-service meter 28. The user would then sign a promotional play form to receive his prize.

As a further option, a user may request a free game voucher from the licensee of the system. When the user presents the game voucher to the licensee, the licensee can enter promotional game credits for that user by means of the promotional play switch 34, which is set to position "B".

Thus, although there have been described particular embodiments of the present invention of a new and useful Collector Card/Phone Card Dispensing System with Promotional Free Spin/Free Draw Game Feature, it is not intended that such references be construed as limitations upon the scope of this invention except as set forth in the following claims.

What is claimed is:

1. A system for dispensing collector cards to a user comprising a. a currency acceptor;

b. a card dispensing mechanism;

c. a processor operatively connected to the currency acceptor and to the card dispensing mechanism whereby a signal is sent to the card dispensing mechanism by the processor to dispense the collector cards in response to receipt of a pre-determined amount of currency at the currency acceptor;

d. a display and user control panel each operatively connected to the processor; and e. the processor including a promotional game sub-system, the game sub-system generating information at the display and receiving information from the user control panel whereby the user can play an electronic promotional game in response to and conditioned on purchase of the collector cards.

2. The system of claim 1 further comprising a game credit accumulator means for electrically storing game credits available to the user for playing the electronic promotional game.

3. The system of claim 2 further comprising a game credit dispensing means for issuing to the user a physical record of game credits available to the user for future play.

4. The system of claim 3 further comprising switch means for a licensee of the system to input user game credits or delete user game credits from the system.

5. A method of dispensing collector cards from a collector card dispensing system to a collector comprising the steps of:

a. accepting currency from the collector at an electromechanical currency acceptor associated with the system;

b. processing in the system currency received signals from the currency acceptor;

c. automatically dispensing the collector cards from a card dispensing mechanism associated with the system when the currency received signals processed reach a predetermined level; and d. providing the collector an option to immediately play an electronic promotional game associated with the system as a reward for purchasing the collector cards.

6. The method of claim 5 further comprising the step of accumulating game credits in the system when the collector successfully plays the promotional game.

7. The method of claim 6 further comprising the step of issuing to the collector a physical record of game credits accumulated by that collector.

8. The method of claim 6 further comprising the step of issuing a prize to the collector in exchange for game credits accumulated by the collector.

9. The method of claim 6 further comprising the steps of issuing a physical record of game credits to the user and electrically entering the game credits reflected on the physical record into the system so that the user can play the promotional game.

* * * * *